US006292079B1

(12) United States Patent
Chan

(10) Patent No.: US 6,292,079 B1
(45) Date of Patent: Sep. 18, 2001

(54) COIL ASSEMBLY OF SPEAKER

(76) Inventor: Yen-Chen Chan, 120, Min An East Road, Hsing Chuang City, Taipei Hsien (TW)

( * ) Notice: Subject to any disclaimer, the term of this patent is extended or adjusted under 35 U.S.C. 154(b) by 0 days.

(21) Appl. No.: 09/657,489

(22) Filed: Sep. 8, 2000

(51) Int. Cl.[7] ..... H01F 15/10; H01F 27/30

(52) U.S. Cl. ..... 335/299; 336/198

(58) Field of Search ..... 335/299; 336/82, 336/123, 181, 182, 185, 195, 198, 208; 381/400–410

(56) References Cited

U.S. PATENT DOCUMENTS 4,397,234 * 8/1983 Lee et al. ..... 101/93.29
5,726,616 * 3/1998 Bell ..... 36/92

* cited by examiner

*Primary Examiner*—Ramon M. Barrera

(57) ABSTRACT

A coil assembly for effectively raising output power of a speaker comprises a double-wall structure composed of an inner and an outer tubular wall, wherein a bottom end of the inner tubular wall is bent outwardly into a flat rim for stopping the outer tubular wall when the same is collared onto the inner tubular wall, and a choking slit is split longitudinally in the outer tubular wall to permit winding two or more layers of coil.

3 Claims, 6 Drawing Sheets

COIL ASSEMBLY OF SPEAKER

BACKGROUND OF THE INVENTION

1. Field of the Invention

This invention relates generally to speakers, and more particularly to a coil assembly of a speaker with improved higher output power and effective heat dissipation.

2. Description of the Prior Art

FIG. 1 shows a conventional single-barrel coil assembly (2) formed by bending a bottom end of a main tube (21) outwardly into a folded rim (211), then winding a coil 22 on the main tube (21) in four layers at least for heat dissipation of the coil 22 through the main tube (21).

Whereas heat can not be well dissipated and output power is stagnated in the conventional coil assembly (2), this invention is to provide an improved coil assembly that can enhance output power and lifetime of a speaker.

SUMMARY OF THE INVENTION

The primary object of this invention is to provide a coil assembly for effectively raising speaker output power by offering a double-wall tubular structure composed of an inner and an outer tubular wall, wherein a bottom end of the inner tubular wall is bent outwardly into a flat rim for stopping the outer tubular wall when the same is collared onto the inner tubular wall; a choking slit is split longitudinally in the outer tubular wall to permit winding two layers of coil.

The commented effectiveness of this invention may be summarized in the following:

1. About 30% improvement is made for output power.

2. Heat of the coil can be dissipated efficiently through the inner and the outer tubular walls.

3. By using the double wall design of this invention, the speaker volume can be minimized.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE PREFERRED EMBODIMENT

Figure 1:
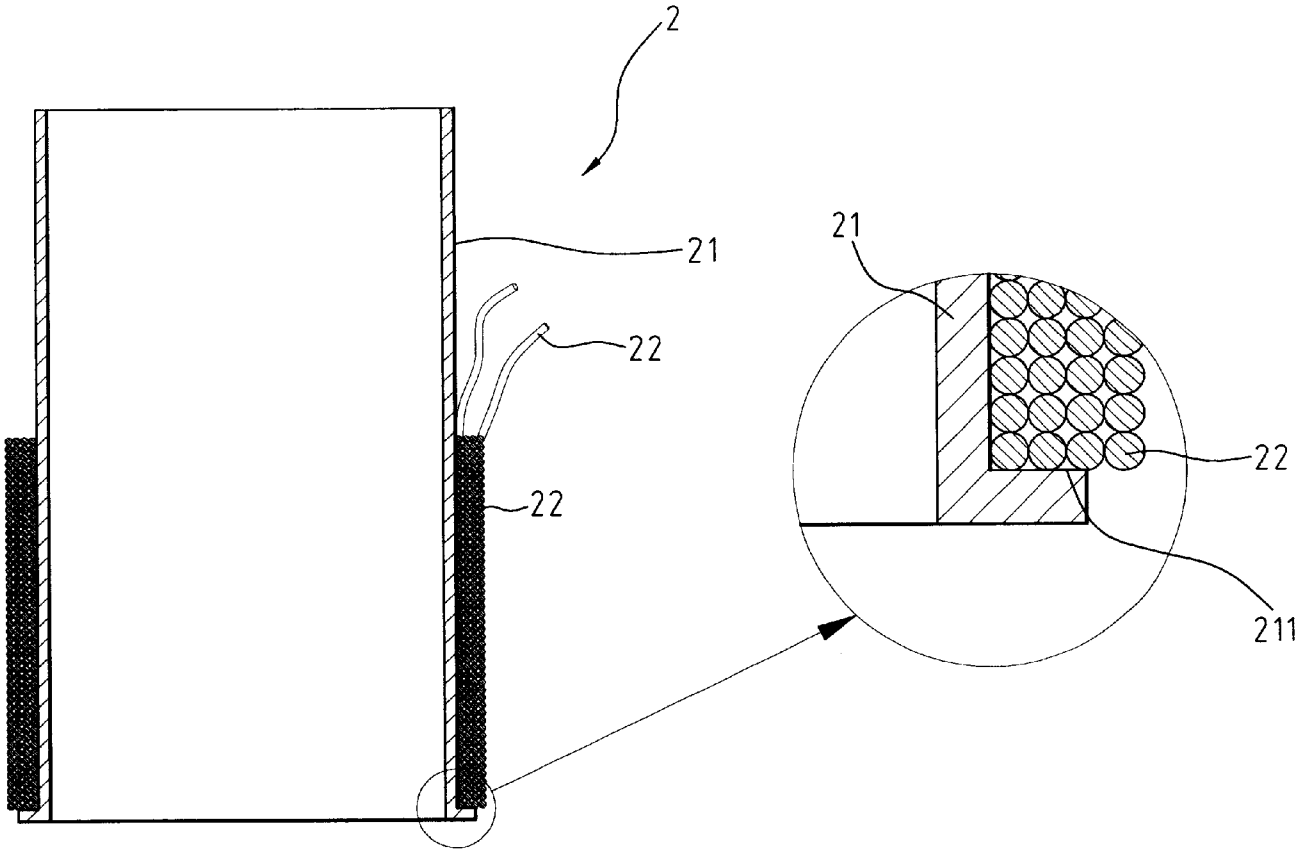
FIG. 1 is a cutaway sectional view of a conventional coil assembly of speaker.
Figure 2:
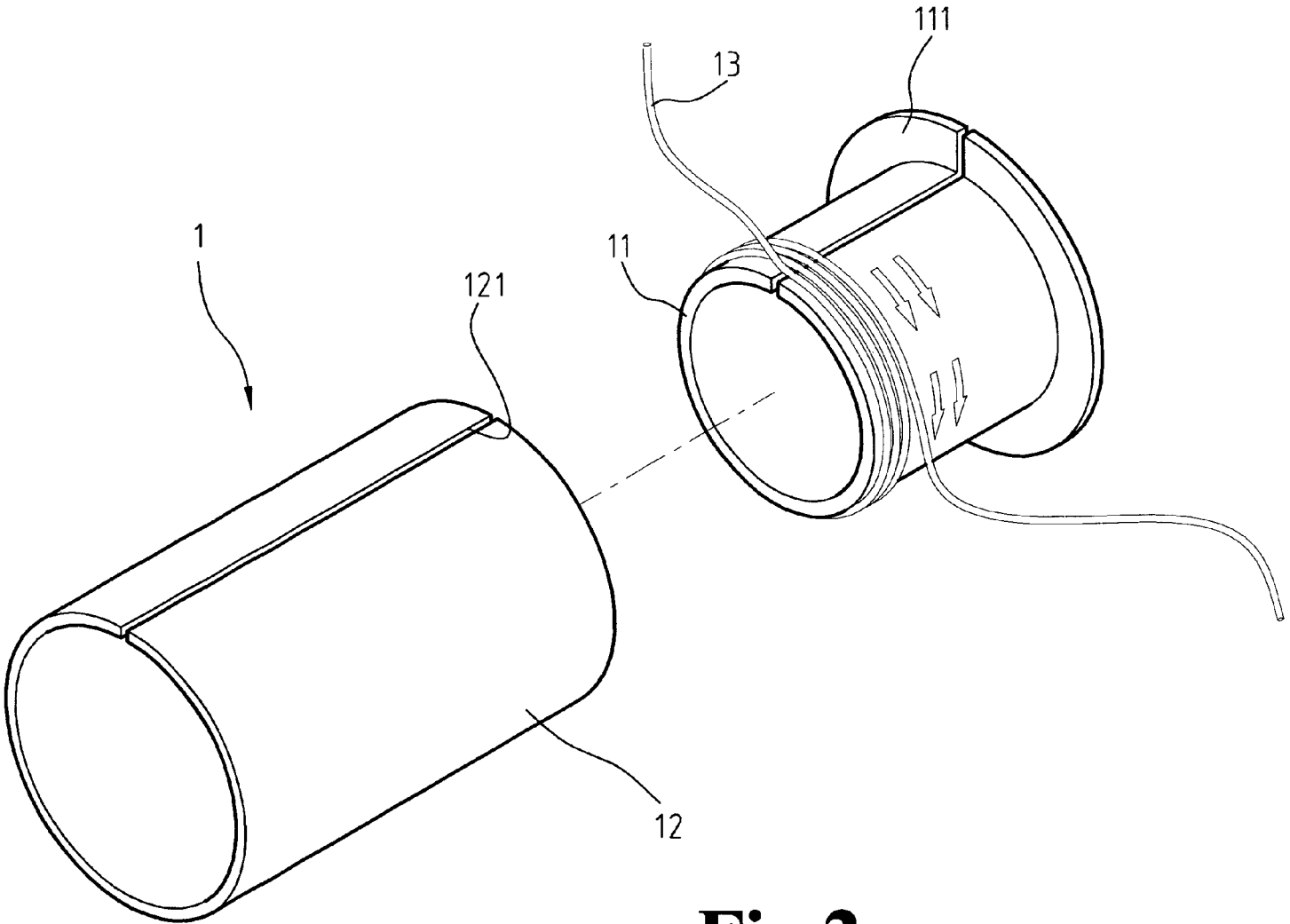
FIG. 2 is a perspective view showing assembling of this invention (1)
Figure 3:
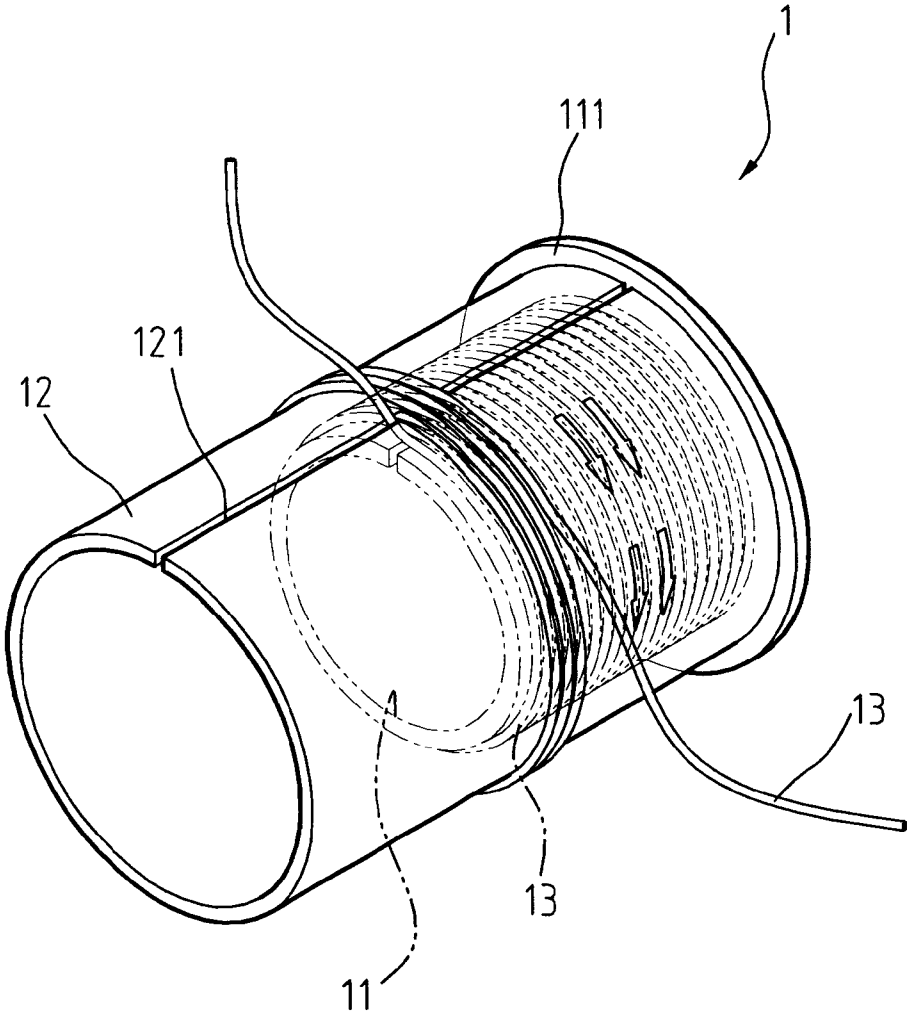
FIG. 3 is another perspective view showing assembling of this invention (2)
Figure 4:
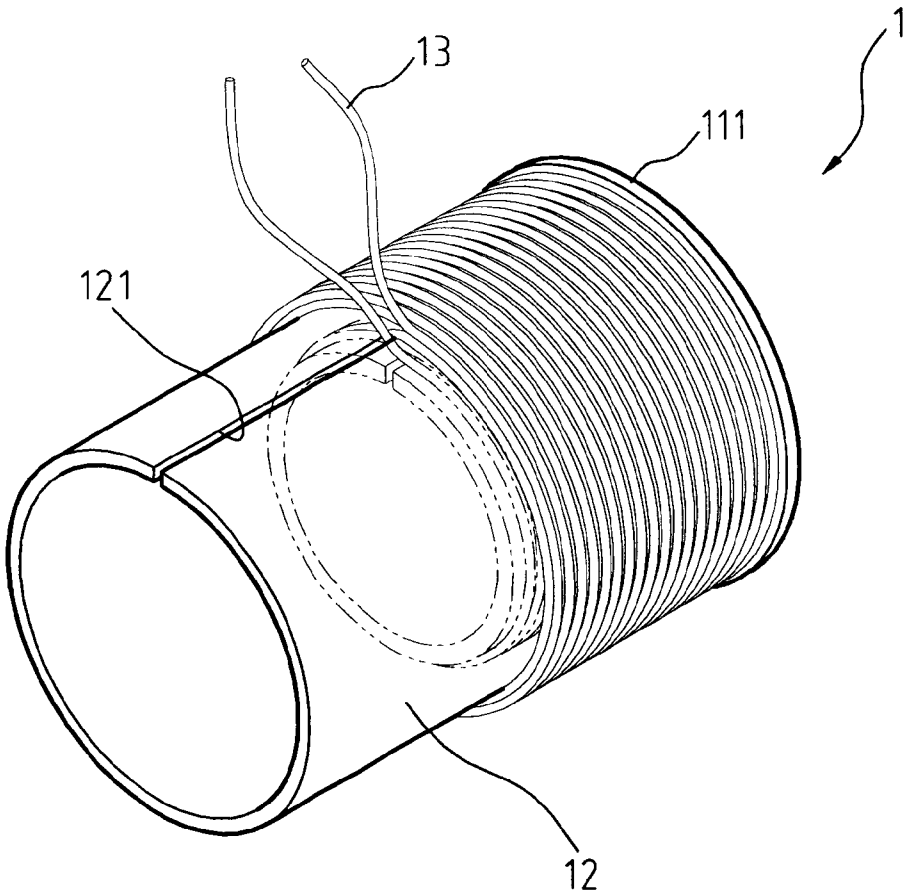
FIG. 4 is a further perspective view showing assembling of this invention (3)

As illustrated in FIGS. 2, 3, and 4 showing embodiments (1), (2), and (3) respectively, a coil assembly 1 of speaker of this invention mainly comprises a double-wall structure including an inner and an outer thin tubular wall 11, 12, which are made of a metallic material, preferably the copper.

The bottom end of the inner tubular wall 11 is bent outwardly into a flat rim 111 for stopping the outer tubular wall 12 when the latter is collared externally on the former, wherein a choking slit 121 is formed by cutting longitudinally from a top rim of the outer tubular wall 12 all the way down to a bottom rim thereof A coil 13 made of copper or preferably a copper plated material with high conductivity is choked initially at a top end of the inner tubular wall 11, and wound on the outer face thereof one lap after another until the bottom end of the inner tubular wall 11 is reached, then the coil 13 is wound to return to the initial top end to build a double-wall coil 13 on the inner tubular wall 11.

Now, the outer tubular wall 12 is clad on the inner tubular wall 11 and stopped at the flat rim 111, and two terminals of the coil 13 on the inner tubular wall 11 are guided penetrating through the choking slit 121 and wound on the outer tubular wall 12 at center portion (at the same height of the double-wall coil on the inner tubular wall 11) then extended to the bottom end of the outer tubular wall 12 and wound returning back to the initial point to form another double-wall coil 13 on the outer tubular wall 12. By winding the way mentioned and after trimming two terminals properly, the coil assembly I of the double-wall structure (including the inner and the outer tubular walls) is provided with a coil 13 in four layers that can conduct power more efficiently.

Figure 5:
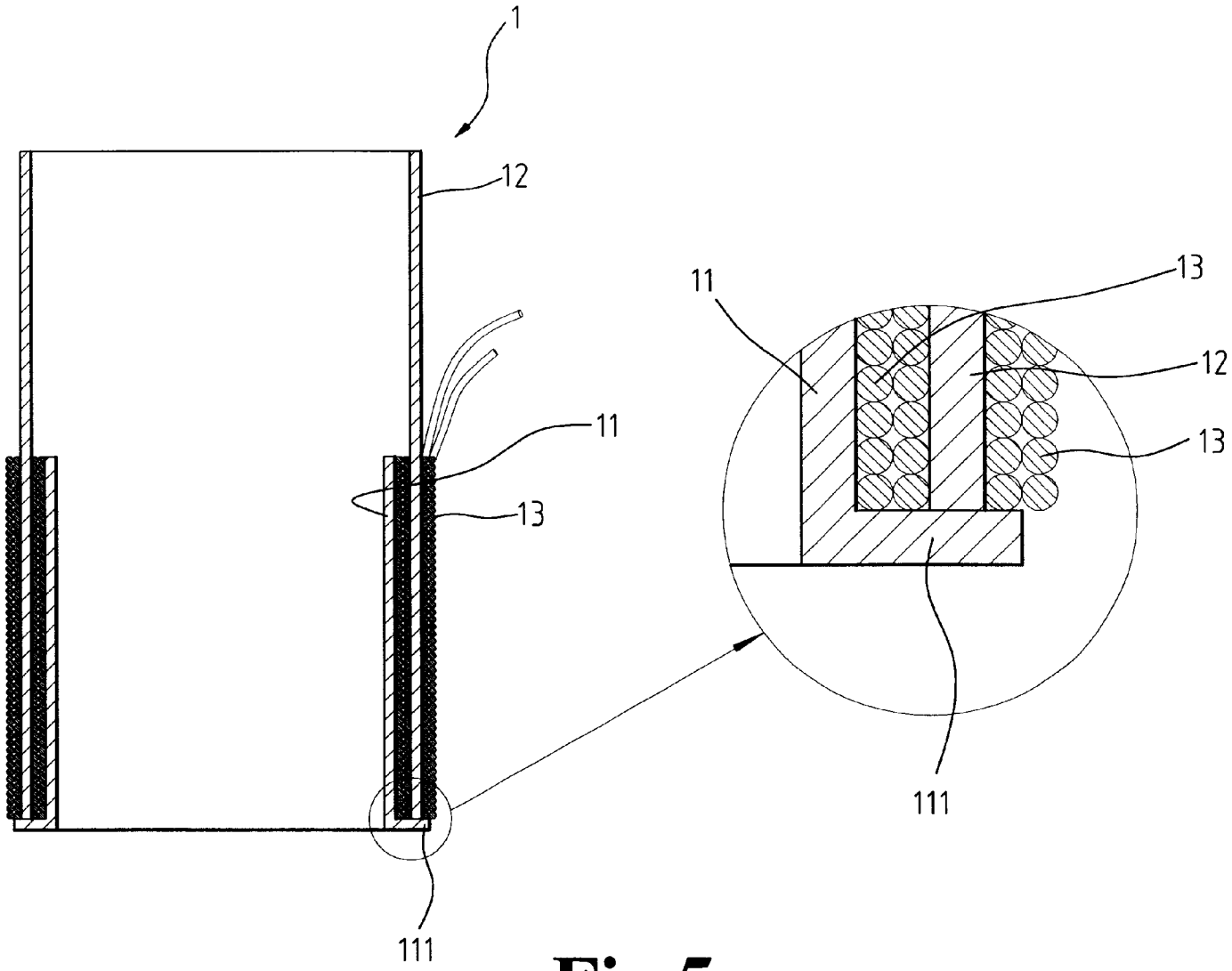
FIG. 5 is a cutaway sectional view of this invention.

In a cutaway sectional view shown in FIG. 5, the coil 13 of this invention is composed of the inner and the outer tubular walls 11, 12, wherein two layers of the coil 13 are disposed on the inner and the outer tubular walls 11, 12 respectively; the layer count is adjustable depending on the requirements; and the coil 13 on the inner and the outer tubular walls are essentially extended from an identical coil; heat of the coil 13 can be dissipated rapidly through the inner and the outer tubular walls 11, 12; when the outer tubular wall 12 is clad on the inner tubular wall 11, the former is stopped by the flat rim 111 of the latter in order not to slip off or scatter those two coil layers 13 on the outer tubular wall 12; and an optimum binder may be applied to the coil 13 on the inner and the outer tubular walls 11, 12 to ensure attachment of the coil 13.

Figure 6:
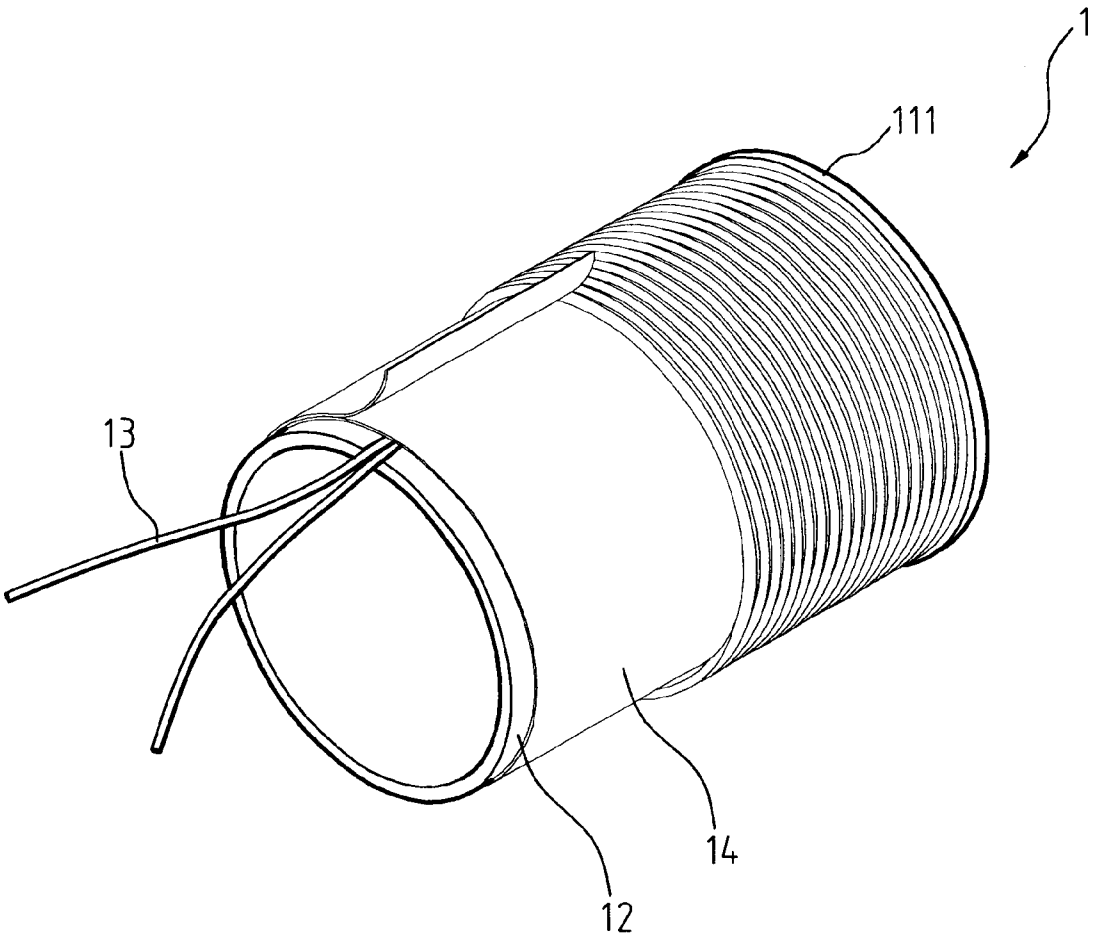
FIG. 6 is a schematic view of an embodiment of this invention.

In FIG. 6, after the coil 13 has been wound on the inner and the outer tubular wall 11, 12, the coil 13 is cut flush to reserve a proper length and covered with an adhesive piece 14 attached on the outer tubular wall 12 at a zone bare of the coil 13 for fixing the terminals of the coil 13.

Although, this invention has been described in terms of preferred embodiments, it is apparent that numerous variations and modifications may be made without departing from the true spirit and scope thereof, as set forth in the following claims.

What is claimed is:

1. A coil assembly of a speaker, comprising:

an inner tubular wall having a flat rim formed at a bottom end;

an outer tubular wall surrounding said inner tubular wall and stopped by said flat rim, said outer tubular wall having a longitudinal slit; and a coil wound on said inner tubular wall to form at least one coil layer between said inner and outer tubular walls, said coil extended through said longitudinal slit and wound on said outer tubular wall to form at least one coil layer around said outer tubular wall.

2. The coil assembly of a speaker as claimed in claim 1, wherein two coil layers are formed between said inner and outer tubular walls and two coil layers are formed around said outer tubular wall.

3. The coil assembly of a speaker as claimed in claim 1, said inner tubular wall having a longitudinal slit.

* * * * *